US009123193B2

(12) United States Patent
Kremer et al.

(10) Patent No.: US 9,123,193 B2
(45) Date of Patent: Sep. 1, 2015

(54) DEVICE FOR RECEIVING NOTES OF VALUE AND METHOD FOR DETERMINING THE STOCK OF A DRUM STORAGE ON THE BASIS OF A MOTOR POSITION

(71) Applicant: Wincor Nixdorf International GmbH, Paderborn (DE)

(72) Inventors: Michael Kremer, Geseke (DE); Thomas Kemmerling, Madfeld (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/256,321

(22) Filed: Apr. 18, 2014

(65) Prior Publication Data

US 2014/0311854 A1 Oct. 23, 2014

(30) Foreign Application Priority Data

Apr. 19, 2013 (EP) ..... 13164492

(51) Int. Cl.
*G07D 11/00* (2006.01)
*B65H 29/00* (2006.01)

(52) U.S. Cl.
CPC ..... *G07D 11/0084* (2013.01); *B65H 29/006* (2013.01); *G07D 11/0072* (2013.01); *B65H 2301/41912* (2013.01);
(Continued)

(58) Field of Classification Search
CPC ..... G07D 11/0084; B65H 29/006; B65H 20/005; B65H 23/00; B65H 39/00; B65H 39/14; B65H 2220/02; B65H 2220/09; B65H 2220/11; B65H 2301/00; B65H 2301/121; B65H 2701/1912
USPC ..... 194/206, 216; 221/71; 209/534; 235/379; 271/145, 256; 242/364.8, 242/528, 534
See application file for complete search history.

(56) References Cited

U.S. PATENT DOCUMENTS

| | | | | |
|---|---|---|---|---|
| 2002/0113160 | A1* | 8/2002 | Niioka et al. | 242/528 |
| 2003/0116400 | A1* | 6/2003 | Saltsov et al. | 194/207 |
| 2010/0133289 | A1 | 6/2010 | Michels | |

(Continued)

FOREIGN PATENT DOCUMENTS

| | | | |
|---|---|---|---|
| DE | 299 23 960 | U1 | 8/2001 |
| DE | 10 2007 022 558 | A1 | 11/2008 |

(Continued)

OTHER PUBLICATIONS

Search Report for Application No. EP 13 16 4492 dated Oct. 14, 2013 (7 pages).

*Primary Examiner* — Mark Beauchaine
(74) *Attorney, Agent, or Firm* — Harness, Dickey & Pierce, P.L.C.

(57) ABSTRACT

The invention relates to a method for determining the stock of notes of value of a drum storage (22). For at least a part of the notes of value, the current motor position is determined after winding up the note of value and stored such that it is unambiguously assigned to the respective note of value. For determining the stock of the drum storage (22), the current motor position is determined and compared with the stored motor positions. Dependent on the result of this comparison, the stock is determined. Further, the invention relates to a device (10, 22, 30) for receiving notes of value, which comprises a drum storage (22), a memory element and a control unit (26), the control unit (26) implementing the above-described method steps.

15 Claims, 4 Drawing Sheets

(52) U.S. Cl.
CPC ..... *B65H 2511/30* (2013.01); *B65H 2511/33* (2013.01); *B65H 2555/26* (2013.01); *B65H 2701/1912* (2013.01)

(56) References Cited

U.S. PATENT DOCUMENTS

2011/0017766 A1 1/2011 Michels et al.
2012/0241283 A1 9/2012 Sakamoto et al.

FOREIGN PATENT DOCUMENTS

| | | | |
|---|---|---|---|
| DE | 10 2009 026 253 | A1 | 2/2011 |
| EP | 0 795 842 | A2 | 9/1997 |
| EP | 2 579 223 | A1 | 4/2013 |
| WO | WO-2013-054575 | A1 | 4/2013 |

* cited by examiner

DEVICE FOR RECEIVING NOTES OF VALUE AND METHOD FOR DETERMINING THE STOCK OF A DRUM STORAGE ON THE BASIS OF A MOTOR POSITION

BACKGROUND OF THE INVENTION

1. Technical Field

The invention relates to a method for determining the stock of notes of value of a drum storage for receiving notes of value. In the method, notes of value are successively received in the drum storage in that a winding drum is rotated by means of a motor so that the notes of value are wound onto the winding drum such that they are arranged between foil tapes. Further, the invention relates to a device for receiving notes of value, which device comprises a drum storage for receiving notes of value that has a winding drum and a motor for rotating the winding drum. Further, the device comprises a memory element for storing data and a control unit for controlling the motor.

2. Discussion

In the case of drum storages, the notes of value to be stored thereon are received between at least two foil tapes and are wound onto a winding drum such that they are arranged between the foil tapes. For this, the winding drum is driven by means of a motor. The control of the motor takes place in particular by means of light barrier signals via which the edges of the notes of value are detected so that it can be correspondingly determined when a note of value has been completely fed or completely removed.

When feeding notes of value as well as when removing notes of value it may happen that notes of value inadvertently overlap each other so that it cannot be detected by means of the light barriers whether one or more notes of value have been fed or removed, respectively. In particular, in the case of overlapping notes of values it cannot be determined how many notes of value overlap and thus have been removed or fed, respectively. This has the consequence that the current stock of notes of value of the drum storage is not known. Since, however, this stock is indispensable for a reliable stock management, it is common practice to completely physically empty the drum storage after the occurrence of an error during the removal or feeding in order to thus establish a reliable stock again.

What is problematic here is that the physical emptying of the drum storage is complex and time-consuming. Further, it might be necessary that the device in which the drum storage is arranged has to be put out of service for this amount of time.

From the documents DE 10 2009 026 253 A1 and DE 10 2007 022 558 A1, drum storages are known in which the drive shaft of the motor is coupled to the foil drum via a hysteresis coupling.

The document DE 299 23 960 U1 describes a drum storage, the supply and storage reels of which are driven by means of a stepper motor. Here, the drive shaft of the motor is coupled to the supply reel via a slip coupling.

SUMMARY OF THE INVENTION

It is an object of the invention to specify a method for determining the stock of notes of value of a drum storage for receiving notes of value and a device for receiving notes of value, by means of which the stock of notes of value of a drum storage can be determined reliably in an easy manner.

According to the invention, at least for a part of the notes of value, the current motor position of the motor is determined after winding up the note of value, wherein the determined motor position is stored such that it is unambiguously assigned to the respective note of value. For determining the stock of notes of value of the drum storage, the current motor position is, for example, determined given the occurrence of an irregularity during the deposit or dispensing of notes of value. This current motor position is compared with the stored motor positions and, dependent on the result of this comparison, the current stock of notes of value of the drum storage is determined.

In this way, it is achieved that the current stock can be determined at any time simply on the basis of the motor position and the stored data. Thus, when errors occur, in particular in the case of overlapping notes of value during feeding or removal, no physical emptying of the drum storage has to take place. In particular, no additional sensor technology has to be provided since all required data can be determined already with the electronic system normally available in drum storages.

By the rigid coupling of the drive shaft of the motor to the winding drum it is ensured that for the same motor position, the winding drum likewise has the same position each time so that each motor position relative to a note of value is unambiguous and invariant.

The stock comprises in particular that one note of value, the assigned and stored motor position of which corresponds to the currently determined motor position as well as all notes of value arranged before this note of value in the receiving order. In the case of a drum storage, the storage takes place according to the principle first in last out so that an unambiguous receiving order is predetermined. By comparing the current motor position with the stored motor positions that one note of value can be determined that must be removed next, i.e. that one note of value that is arranged directly in front of the exit of the drum storage. Thus, inevitably also all notes of value that are arranged before this note of value in the receiving order are received in the drum storage so that the stock is formed by these notes of value altogether.

In an alternative embodiment of the invention, also that one note of value, the assigned and stored motor position of which has the smallest difference to the currently determined motor position as well as all notes of value arranged before this note of value in the receiving order can be determined as the stock of the drum storage. Compared to the method described before, in which the determined motor position must exactly correspond to one of the stored motor positions, it is here achieved that the method leads to the correct result also in the case of small insignificant deviations. In particular, a maximum value is preset which defines the maximum admissible deviation between the determined and the stored motor positions. If this maximum difference is exceeded, then an error message is output and no stock is determined.

In a particularly preferred embodiment, during feeding of each note of value to the drum storage, the motor position of the motor is determined and stored such that it is unambiguously assigned to the note of value, provided that upon feeding no error, in particular no overlapping of several notes of value to be fed occurs. Thus, it is achieved that the motor position is known with respect to each note of value and thus, independent of the fact at which note of value the error occurs, the stock can be determined on the basis of the motor position. In an alternative embodiment, the motor position may be determined and stored for example only for each second note of value. In this case, it may happen that, for determining the motor position after an error, at first a note of value has to be removed before a corresponding note of value and thus a corresponding stock can be determined on the basis of the thus resulting motor position.

As a motor position, in particular in each case a number of steps of the motor is stored, by which it is moved with respect to a predetermined zero position in the respective motor position. Alternatively, also a plurality of possible motor positions can be preset, wherein the respective motor position at which the notes of value are received is assigned to them.

The respective current motor position is determined in particular by means of the electronic system for driving the motor, preferably based on a motor drive signal. Alternatively, also a separate sensor technology may be provided. The use of the electronic system for driving the motor has the advantage that no additional component parts are required and a simple cost-efficient structure is achieved.

Further, it is advantageous when the receiving order in which the notes of value are received in the drum storage is stored. In particular, a list, a table or a data base is provided in which for each note of value a data set is created which contains at least the position of the note of value in the receiving order and the corresponding motor position. In addition, for each note of value still further data, for example its denomination can be stored.

When, during feeding of notes of value, several notes of value are received in an overlapping manner in the drum storage, which can be determined, for example, by means of light barriers, the notes of value are removed from the drum storage until a note of value has been removed to which a motor position is assigned and stored. As a stock, then the notes of value following this note of value in the receiving order are determined. In this way, when feeding overlapping notes of value, the stock of the drum storage can again be guaranteed without an emptying of the drum storage in that all notes of value fed in an overlapping manner are again removed. By removing a further note of value and by determining the motor position after removal of this note of value, an unambiguous assignment can take place on the basis of the stored data so that it is again known at which position in the receiving order one is.

When an irregularity is detected during the removal of notes of value, for example, when light barrier signals result in that more than one note of value has been removed in an overlapping manner so that the current stock of the drum storage is not known, then notes of value are successively removed, the motor position is determined during removal of each note of value and the determined motor position is compared with the stored motor positions preferably until the determined motor position corresponds with the respectively stored motor position for a preset number of successively removed notes of value. In this case, then the note of value directly following the last removed note of value in the receiving order as well as all notes of value arranged further up in the receiving order are determined as a stock. Thus, by comparing the motor positions of the removed notes of value with the stored motor positions again reliable information on the stock can be obtained after the occurrence of overlappings.

The predetermined number of notes of value is at least two, preferably three notes of value. The higher the number, the more reliable it can be assumed that a guaranteed stock has been determined again.

When feeding a note of value, the winding drum is rotated by the motor in particular until by means of a sensor, preferably a light barrier, it has been determined that the note of value is completely received. In particular, the rear edges of the notes of value are detected by means of light barriers as a change of flanks. Thereafter, the winding drum is stopped and the motor position is determined and stored such that it is assigned to the note of value. When several notes of value are fed, the determination of the motor position takes place in particular during the ongoing operation, i.e. that the motor is not stopped for this.

A further aspect of the invention relates to a device for receiving notes of value, which device comprises a drum storage for receiving notes of value that has a winding drum and a motor for rotating the winding drum. Further, a memory element for storing data and a control unit are provided. The control unit determines, at least for a part of the notes of value, the current motor position of the motor after winding up the note of value. Further, the control unit stores the determined motor position in the memory element such that it is unambiguously assigned to the respective note of value. For determining the stock of notes of value of the drum storage, the control unit determines a current motor position and compares this determined current motor position with the stored motor positions. Dependent on the result of this comparison, the control unit then determines the current stock. The control unit in particular implements this when there have been irregularities during the removal or the feeding of notes of value, in particular when it has been determined that notes of value have been fed or removed in an overlapping manner.

The motor is in particular a brushless direct current motor. This direct current motor can be designed in particular in the form of a stepper motor. Alternatively, also a sensor-controlled brushless direct current motor can be used, which comprises position sensors by means of which the current position of the motor can be detected. Further, alternatively, also sensor-less, brushless direct current motors can be used, which determine the current position of the motor by means of the counter-voltage method. Likewise, also a direct current motor with clock generator can be used.

In addition, also other stepper motors, i.e. stepper motors which are no brushless direct current motors, can be used. Further, also other direct current motors, i.e. direct current motors that are not brushless, can be used.

All these afore-described motors have the advantage that their motor position can be determined very accurately.

The drive shaft of the motor is in particular rigidly coupled to the winding drum so that to each motor position a rotary position of the winding drum and thus a note of value can be assigned unambiguously.

The device for receiving notes of value is in particular an automated teller machine, an automatic POS system and/or an automated teller safe. The drum storage can be permanently fixed in the respective device or, alternatively, also be arranged in a removable cash cassette. In the latter case, the control unit is in particular a control unit of the device and the memory element is a memory element of the cash cassette so that even if the cash cassette is removed, the stored information is still maintained. Alternatively or additionally, the storage can also be accomplished on a memory element of the device.

Alternatively, the device for receiving notes of value can also just be a cash cassette per se, which, in this case, has to comprise an own control unit.

The device can be developed with the features described in the dependent method claims which are dependent on the independent method claim or with corresponding device features. In particular, the method steps described in the dependent method claims are implemented by the control unit of the device by executing preset steps of a data program. On the other hand, the method according to claim 1, too, can be developed with the features mentioned in the dependent device claims or corresponding method features.

BRIEF DESCRIPTION OF THE DRAWINGS

Further features and advantages of the invention result from the following description which explains the invention in more detail on the basis of embodiments in connection with the enclosed Figures.

DETAILED DESCRIPTION OF THE PREFERRED EMBODIMENTS

Figure 1:
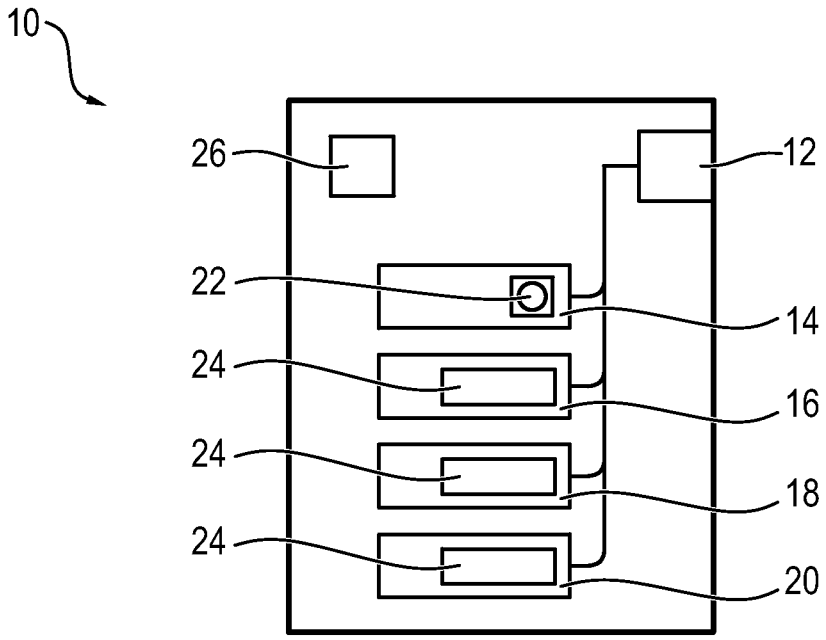
FIG. 1 shows a schematic device for handling notes of value according to a first embodiment.

In FIG. 1, a schematic illustration of a device for handling notes of value is illustrated. The device 10 can, for example, be an automated teller machine, an automatic POS system or an automated teller safe.

The device 10 comprises an input and output compartment 12 for the input and output of notes of value as well as four cash cassettes 14 to 20 for receiving notes of value. In the embodiment shown in FIG. 1, the cash cassette 14 comprises a drum storage 22 on which the notes of value to be received are wound up onto a winding drum such that they are arranged between foil tapes. The exact structure of such a drum storage will still be described in more detail in the following in connection with FIG. 3.

The other three cash cassettes 16 to 20 are designed such that the notes of value to be received are in each case received as a value note stack in a receiving compartment 24 in a manner so as to stand on their edges. Of course, alternatively, also more cash cassettes 14 having a drum storage 22 and instead less cash cassettes 16 to 20 having a receiving compartment can be used. In addition, the device 10 can also comprise more or less than four cash cassettes 14 to 20.

The device 10 further has a control unit 26 for controlling the device 10. In addition, the device 10 can also have a non-illustrated memory element for storing data. The cash cassettes 14 to 20, too, can comprise memory elements for storing data with information about the notes of value received therein.

Figure 2:
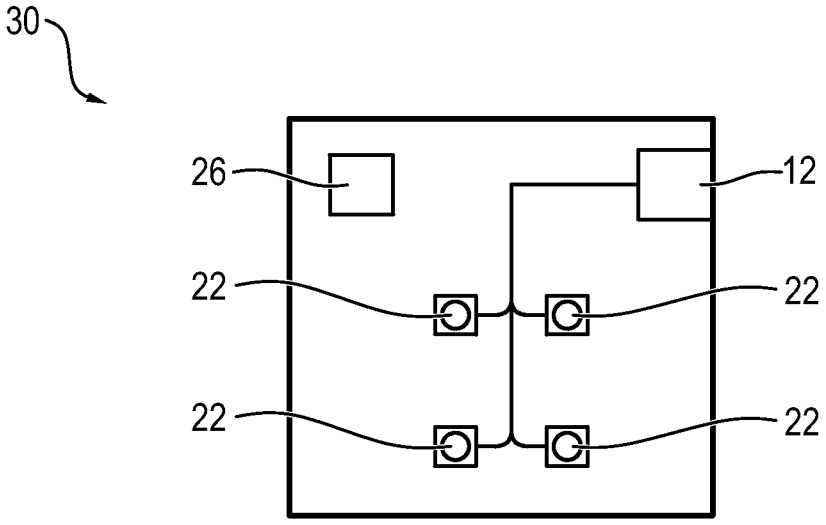
FIG. 2 shows a schematic illustration of a device for handling notes of value according to a second embodiment.

In FIG. 2, a schematic illustration of a device for handling notes of value according to a second embodiment is illustrated. Elements having the same structure or the same function have the same reference signs.

The device 30 according to FIG. 2 differs from the device 10 according to the first embodiment according to FIG. 1 in that it comprises four stationary drum storages 22 instead of cash cassettes 14 to 20, i.e. that these drum storages 22 are arranged permanently in the device 30 and are not removed for the transport of notes of value. Alternatively, the device 30 can also comprise both stationarily arranged drum storages 22 and devices for receiving notes of value designed in the form of cash cassettes 14 to 20.

The following methods described in connection with FIGS. 4 to 6 for determining the stock of notes of value of a drum storage 22 can be used for any type of drum storage 22, no matter whether it is arranged stationarily in a device 10, 30 or in a cash cassette 14. Here, the individual method steps are in particular performed by the control unit 26. The storage of the data can be accomplished both in a memory element of the device 10, 30 as well as of the cash cassettes 14 or of the drum storage 22.

Figure 3:
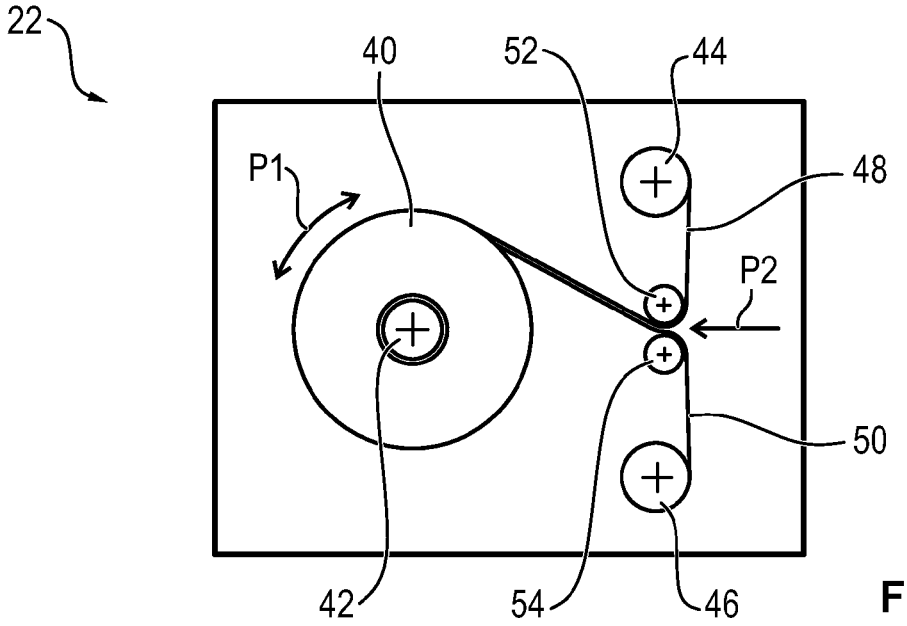
FIG. 3 shows a schematic illustration of a drum storage.

In FIG. 3, a drum storage 22 is schematically illustrated. The drum storage 22 has a winding drum 40 and a motor 42 for rotating the winding drum 40 in the direction of the double arrow P1. The motor 42 is in particular a brushless direct current motor which is preferably designed in the form of a stepper motor. The motor 42 has a non-illustrated drive shaft which is rigidly coupled to the winding drum 40. Rigidly coupling is in particular defined in that no relative rotation of the drive shaft and the winding drum 40 to each other is possible.

Further, the drum storage 22 has two foil supply rolls 44, 46 onto which foil tapes 48, 50 are wound which are guided over guiding rolls 52, 54. A note of value to be received in the drum storage 22 is fed thereto in the direction of the arrow P2 such that it is received between the two foil tapes 48, 50. By rotating the winding drum 40 by means of the motor 42 the note of value is wound onto the winding drum 40 such that it is received between the foil tapes 48, 50. Here, the individual notes of value to be received are successively received so that a removal of notes of value from the drum storage 22 is only possible according to the principle last in first out.

Figure 4:
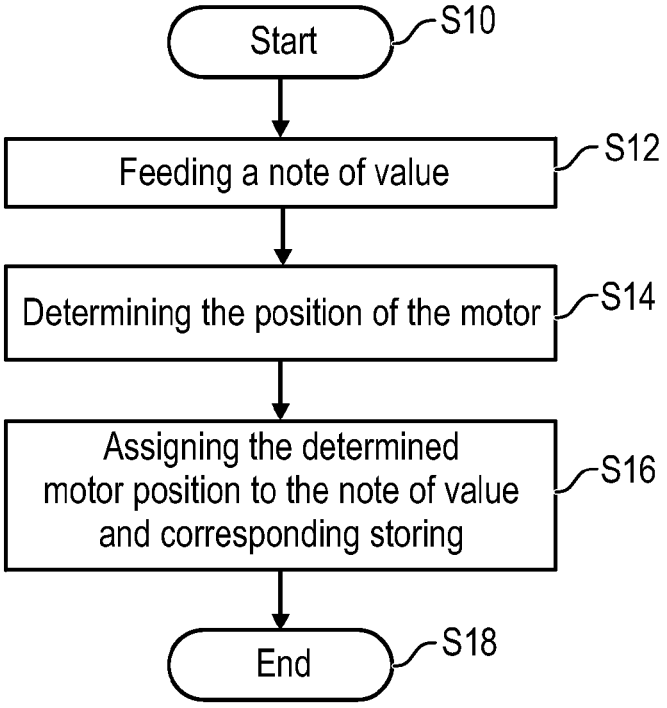
FIG. 4 shows a flow chart of a method for feeding notes of value to a drum storage.

In FIG. 4, a flow chart of a method for receiving notes of value in a drum storage 22 is illustrated. After the method has been started in step S10, in step S12 a note of value is fed, wherein, during feeding, in particular the winding drum 40 is rotated by the motor 42 until the note of value to be fed is completely received. Thereafter, in step S14 the current motor position of the motor 42 is determined. The current motor position is determined in particular as a number of steps by which the motor 42 has to be rotated with respect to a zero position in order to be arranged in the current motor position.

Thereafter, in step S12 the determined motor position is assigned to the last received note of value and is stored in a non-illustrated memory element such that it is unambiguously assigned to the note of value. Afterwards, the method is terminated in step S18. The storage of the individual motor positions is in particular accomplished in a memory element of the device 10, 30 for handling notes of value, the cash cassette 14 in which the drum storage 22 is received or in an own memory element of the drum storage 22. The determination of the position of the motor 42 in particular is accomplished by means of the electronic system of the motor 42, wherein the assignment and storage is controlled in particular by the control unit 26.

When notes of value 24 are fed to the drum storage 22, it may happen that notes of value overlap so that not to each and every note of value a motor position can be assigned and no systematic dispensing of these overlapping notes of value is possible since no unambiguous light barrier signals for controlling such dispensing are possible. In particular, this also results in that the stock of notes of value of the drum storage 22 is not known.

When notes of value are removed, irregularities may likewise occur so that also during the removal the current stock of the drum storage 22 may be unclear. In both cases, the method for determining the stock of notes of value of the drum storage 22 described in FIGS. 5 and 6 can be performed, as a result whereof the current stock of notes of value of the drum storage 22 can again be determined in an easy manner after the occurrence of an irregularity. In particular, both methods have the advantage that no physical emptying of the drum storage 22 is necessary.

Figure 5:
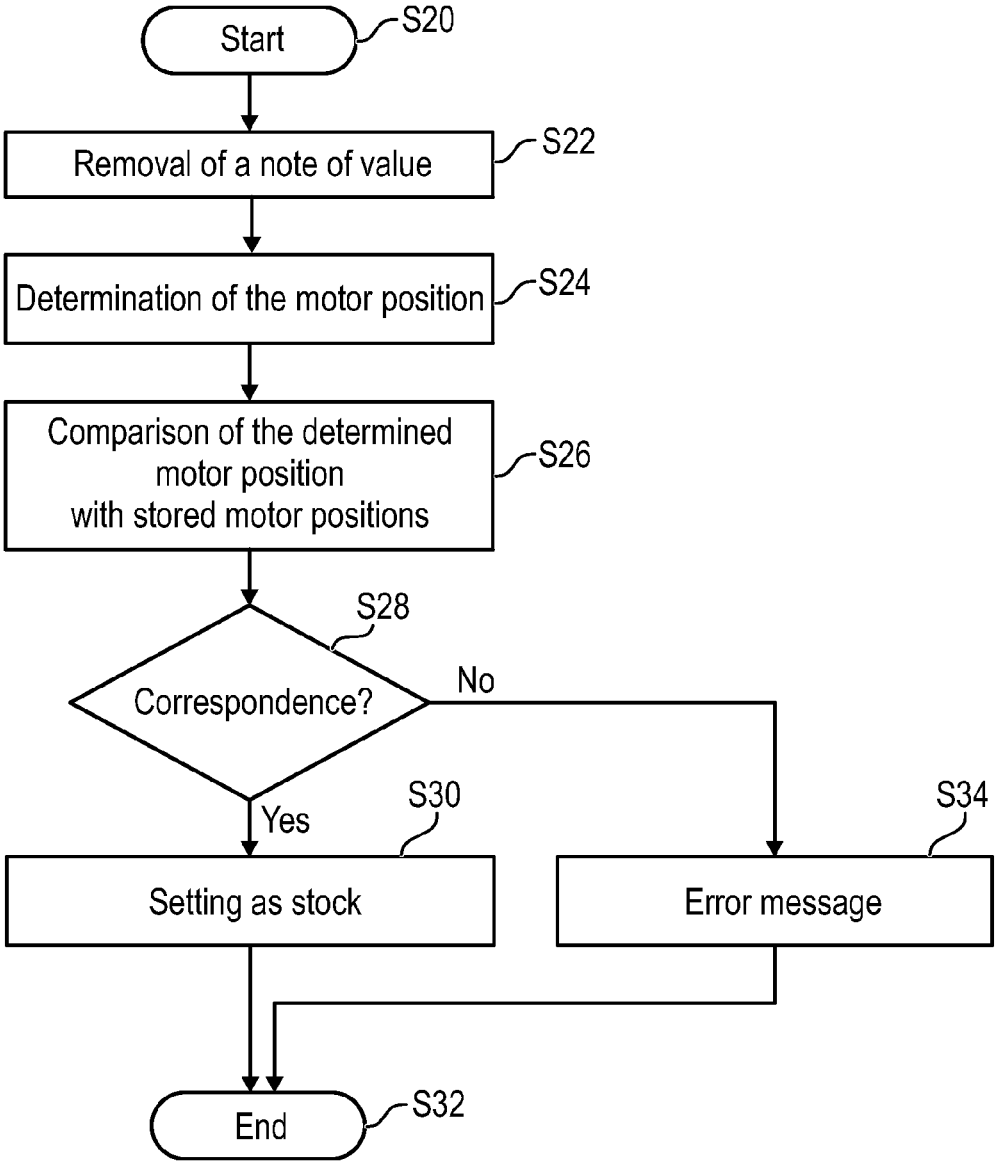
FIG. 5 shows a flow chart of a method for determining the stock of notes of value of a drum storage according to a first embodiment.

After the method according to a first embodiment, as shown in FIG. 5, has been started in step S20, a note of value is removed in step S22 and the current motor position of the motor 42 is determined after the removal of the note of value in step S24.

Thereafter, in step S26 a comparison of the current motor position determined in step S24 with the motor positions stored in the memory element takes place. In the following step S28, it is determined whether the current motor position corresponds to one of the stored motor positions. If this is the case, then in step S30 the current stock can be determined before the method is terminated in step S32. By way of correspondence between the current motor position and one of the stored motor positions it can be determined due to the rigid coupling between the motor 42 and the winding drum 40 and thus the unambiguous reliable invariant assignment between a motor position and a winding drum position which of the received notes of value is the next, as viewed in the receiving order, that is arranged in front of the exit of the drum storage 22 and thus must be removed next. By this, it is also clear that all other notes of value arranged even before this note of value in the receiving order are likewise still arranged in the drum storage 22 so that the stock can again be determined reliably.

When, however, it has been determined in step S28 that no correspondence between the determined motor position and the stored motor positions exists, then the stock cannot be determined and an error message is output in step S34 before the method is terminated in step S32.

In the determination of the correspondence 28 in particular also a lower tolerance difference may be preset so that little deviations between the stored motor position and the actual motor position resulting from environmental influences do not directly result in that no assignment is possible but nevertheless a note of value assigned to the motor position as well as the stock of notes of value in the drum storage can be determined.

Figure 6:
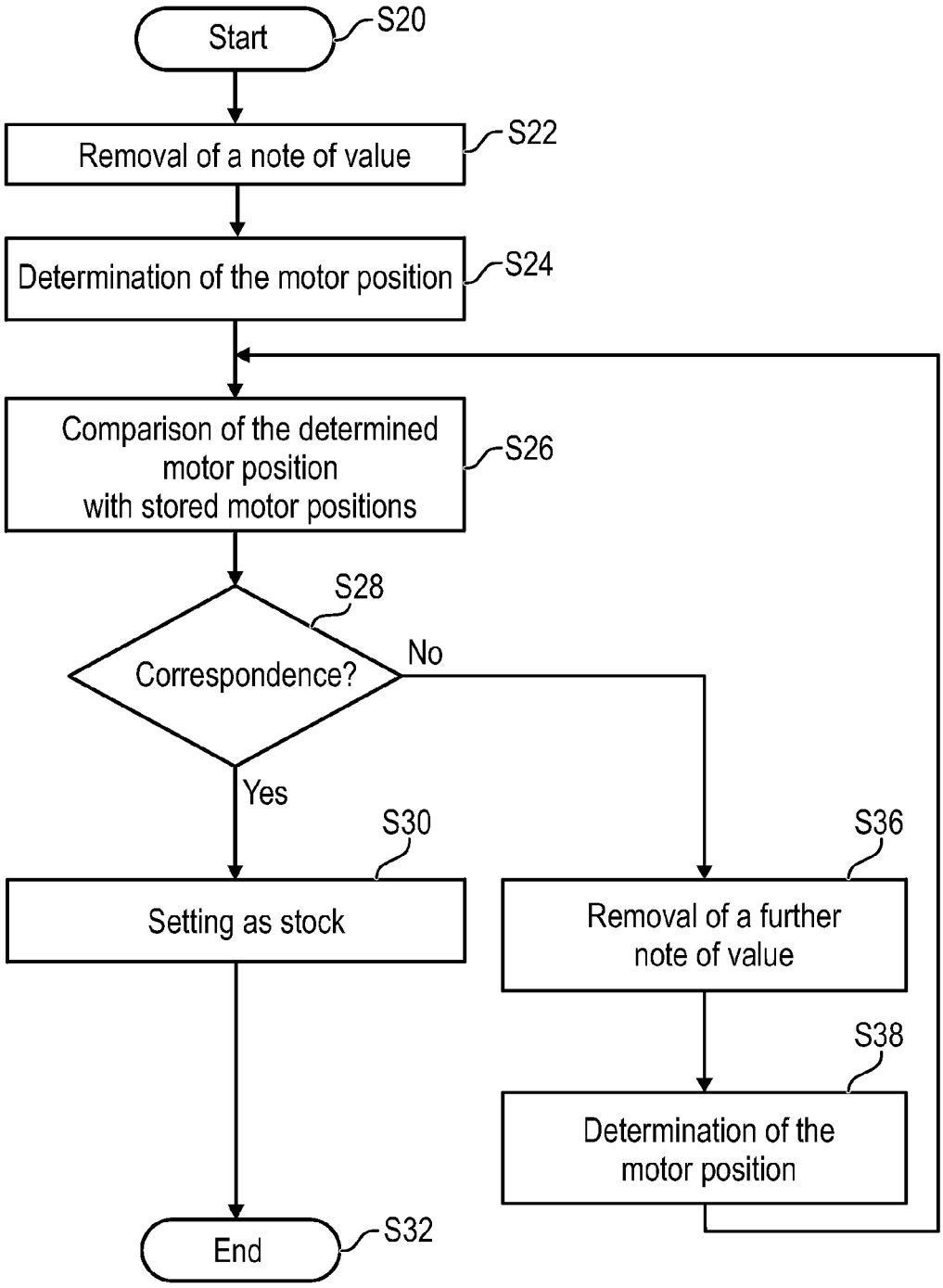
FIG. 6 shows a flow chart of a method for determining the stock of notes of value of a drum storage according to a second embodiment.

In FIG. 6, a flow chart of a method for determining the stock of notes of value of a drum storage 22 according to a second embodiment is illustrated. This method differs from the method according to FIG. 5 in that when no correspondence has been determined in step S28 a further note of value is removed from the drum storage 22 in step S36 and the current motor position of the motor 42 is determined after the removal of this further note of value in step S38. Thereafter, the method is continued in step S28 in that it is again determined whether there is a correspondence between the new current motor position now determined in step S38 and one of the stored motor positions. If this is the case, the stock can be determined on the basis of the motor position, and the method can be terminated. If this is still not the case, then the method is again continued with steps S36 and S38, i.e. a further note of value is removed and after removal of this further note of value the new motor position is determined before once again a comparison between the now new current motor position and the stored motor positions takes place. This is in particular continued until there is a correspondence between a determined and a stored motor position so that the stock can be determined.

Alternatively, also a maximum number of notes of value to be maximally removed for the determinations can be preset. Even if after removal of the preset maximum number of notes of value no correspondence and thus no stock could be determined, then the method is in particular terminated and an error message is output so that a manual intervention is inevitable.

In a further preferred embodiment, the stock may also only be assumed as being guaranteed again when for a predetermined number of successively removed notes of value there is always a correspondence between the respective currently determined motor position and the correspondingly assigned stored motor position. This has the advantage that, with an even higher reliability, a guaranteed stock can be inferred since the random correspondence is the more unlikely, the more successively removed notes of value each have the matching motor position.

The above described methods represent preferred embodiments. Individual method steps may also be omitted, provided that in general, according to the invention, the stock of notes of value of the drum storage 22 is determined in that a comparison of a current motor position with stored motor positions takes place.

The entire disclosure of European Patent Application No. 13 164 492.4, filed Apr. 19, 2013 is expressly incorporated by reference herein.

The invention claimed is:

1. A method for determining the stock of notes of value of a drum storage for receiving notes of value, in which notes of value are successively received in a drum storage in that a winding drum is rotated by means of a motor so that the notes of value are wound onto the winding drum such that they are received between foil tapes, comprising wherein:

at least for a part of the notes of value the current motor position of the motor is determined after winding up the note of value, the determined motor position is stored such that it is unambiguously assigned to the respective note of value, and for determining the stock of notes of value of the drum storage a current motor position is determined, this determined motor position is compared with the stored motor positions and, dependent on the result of this comparison, the stock is determined.

2. The method according to claim 1, wherein as a stock of the drum storage that one note of value, the assigned and stored motor position of which corresponds to the currently determined motor position, as well as all notes of value arranged before this note of value in the receiving order are determined.

3. The method according to claim 1, wherein as a stock of the drum storage that one note of value, the assigned and stored motor position of which has the smallest difference to the currently determined motor position, as well as all notes of value arranged before this note of value in the receiving order are determined.

4. The method according to claim 1, wherein during feeding of each note of value to the drum storage the motor position of the motor is determined after feeding and stored such that it is unambiguously assigned to the note of value, provided that during feeding no error, in particular no overlapping of several notes of value to be fed occurs.

5. The method according to claim 1, wherein as a motor position in each case a number of steps of the motor by which it is moved with respect to a predetermined zero position is stored.

6. The method according to claim 1, wherein a plurality of motor positions is preset, and that the respective motor position is assigned to the notes of value.

7. The method according to claim 1, wherein the respective current motor position is determined by means of the electronic system of the motor.

8. The method according to claim 1, wherein the receiving order in which the notes of value are received in the drum storage is stored and that the respective motor position is stored such that it is assigned to the respective notes of value.

9. The method according to claim 1, wherein when, during feeding of notes of value, several notes of value are received on the drum storage in an overlapping manner, notes of value are removed from the drum storage until a note of value has been removed to which a motor position is assigned, and that as a stock the note of value directly following this note of value in the receiving order as well as all notes of value arranged further up in the receiving order are determined.

10. The method according to claim 1, wherein when an irregularity is detected during the removal of notes of value so that the current stock of the drum storage is not known, notes of value are successively removed, the motor position during the removal of each note of value is determined and the determined motor position is compared with the stored motor positions until the determined motor position corresponds to the stored motor position for a preset number of successively removed notes of value, and that the note of value directly following the last-removed note of value in the receiving order as well as all notes of value arranged further up in the receiving order are determined as a stock.

11. The method according to claim 10, characterized in that the preset number is at least two.

12. The method according to claim 1, wherein during feeding of a note of value the motor rotates the winding drum until by means of a sensor, in particular a light barrier, it has been determined that the note of value is completely received, and that then the motor position is determined and assigned to the note of value.

13. A device for receiving notes of value, comprising:

a drum storage for receiving the notes of value, wherein the drum storage comprises a winding drum and a motor for rotating the winding drum, a memory element for storing data, and a control unit, wherein the control unit determines at least for a part of the notes of value the current motor position of the motor after winding up the note of value, the control unit stores the determined motor position in the memory element such that it is unambiguously assigned to the respective note of value, and the control unit for determining the stock of notes of value of the drum storage determines a current motor position of the motor, compares this determined motor position with the stored motor positions and, dependent on the result of this comparison, determines the stock.

14. The device according to claim 13, wherein the motor is a brushless direct current motor.

15. The device according to claim 13, wherein the motor is a stepper motor.

* * * * *